US010900109B2

(12) United States Patent
Mitsuda et al.

(10) Patent No.: US 10,900,109 B2
(45) Date of Patent: Jan. 26, 2021

(54) TITANIUM SHEET AND METHOD FOR MANUFACTURING THE SAME

(71) Applicant: NIPPON STEEL & SUMITOMO METAL CORPORATION, Tokyo (JP)

(72) Inventors: Koji Mitsuda, Tokyo (JP); Kazuhiro Takahashi, Tokyo (JP); Hideto Seto, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 14 days.

(21) Appl. No.: 16/306,998

(22) PCT Filed: Jul. 8, 2016

(86) PCT No.: PCT/JP2016/070303

§ 371 (c)(1),
(2) Date: Dec. 4, 2018

(87) PCT Pub. No.: WO2018/008151

PCT Pub. Date: Jan. 11, 2018

(65) Prior Publication Data

US 2019/0300996 A1 Oct. 3, 2019

(51) Int. Cl.
*C22F 1/00* (2006.01)
*C22F 1/02* (2006.01)
(Continued)

(52) U.S. Cl.
CPC ..... *C22F 1/183* (2013.01); *C22F 1/02* (2013.01); *C22F 1/18* (2013.01); *C22C 14/00* (2013.01); *C22F 1/00* (2013.01)

(58) Field of Classification Search
CPC ..... C22F 1/00; C22F 1/02; C22F 1/18; C22F 1/183; C22C 14/00
(Continued)

(56) References Cited

U.S. PATENT DOCUMENTS

2012/0135855 A1* 5/2012 Kaneko ..... B01J 35/004 502/5
2016/0056479 A1* 2/2016 Itsumi ..... H01M 8/0206 429/514

FOREIGN PATENT DOCUMENTS

JP 54-88858 A 7/1979
JP 60-44041 B2 10/1985
(Continued)

OTHER PUBLICATIONS

English translation of International Preliminary Report on Patentability and Written Opinion dated Jan. 17, 2019, in PCT/JP2016/070303 (Forms PCT/IB/326, PCT/IB/373, and PCT/ISA/237).
(Continued)

*Primary Examiner* — Brian D Walck
(74) *Attorney, Agent, or Firm* — Birch, Stewart, Kolasch & Birch, LLP

(57) ABSTRACT

To provide a titanium sheet excellent in formability and a method for manufacturing the same. A titanium sheet, wherein, when a carbon concentration of a base material is $C_b$ (mass %) and a carbon concentration at a depth d μm from a surface is $C_d$ (mass %), the depth d (carbon concentrated layer thickness) satisfying $C_d/C_b>1.5$ is 1.0 μm or more and less than 10.0 μm or less, wherein a Vickers hardness $HV_{0.025}$ at a load of 0.245 N in the surface is 200 or more, a Vickers hardness $HV_{0.05}$ at a load of 0.49 N in the surface is lower than $HV_{0.025}$, and a difference between $HV_{0.025}$ and $HV_{0.05}$ is 30 or more, wherein a Vickers hardness $HV_1$ at a load of 9.8 N in the surface is 150 or less, and wherein an average interval between cracks generated in the surface when a strain of 25% is given in a rolling direction in a bulging forming process is less than 50 μm and a depth thereof is 1 μm or more and less than 10 μm.

2 Claims, 3 Drawing Sheets

(51) Int. Cl.
*C22F 1/18* (2006.01)
*C22C 14/00* (2006.01)

(58) Field of Classification Search
USPC ..... 148/670
See application file for complete search history.

(56) References Cited

FOREIGN PATENT DOCUMENTS

| | | | |
|---|---|---|---|
| JP | 1-201452 | A | 8/1989 |
| JP | 2001-303223 | A | 10/2001 |
| JP | 2002-3968 | A | 1/2002 |
| JP | 2002-180236 | A | 6/2002 |
| JP | 2011-20135 | A | 6/2002 |
| JP | 2002-194591 | A | 7/2002 |
| JP | 2005-298930 | A | 10/2005 |
| JP | 2010-255085 | A | 11/2010 |
| JP | 2013-10115 | A | 1/2013 |
| WO | WO 2010/126051 | A1 | 11/2010 |
| WO | WO 2014/156673 | A1 | 10/2014 |

OTHER PUBLICATIONS

International Search Report for PCT/JP2016/070303 dated Sep. 20, 2016.
Written Opinion of the International Searching Authority for PCT/JP2016/070303 (PCT/ISA/237) dated Sep. 20, 2016.
Extended European Search Report, dated Oct. 4, 2019, for European Application No. 16908195.7.

* cited by examiner (b) SAMPLE SHEET No. A24

(a) SAMPLE SHEET No. A4

(a) SAMPLE SHEET No. A4 (b) SAMPLE SHEET No. A24

TITANIUM SHEET AND METHOD FOR MANUFACTURING THE SAME

TECHNICAL FIELD

The present invention relates to a titanium sheet and a method for manufacturing the same. The present invention relates in particular to a titanium sheet excellent in formability and a method for manufacturing the same.

BACKGROUND ART

Since a titanium sheet is excellent in corrosion resistance, it is used as a material for a heat exchanger in various plants such as a chemical plant, an electric power plant and a food manufacturing plant. Among the above, Plate type heat exchanger, in which a titanium sheet is given projections and recesses by press-forming to increase a surface area to thereby heighten a heat exchange efficiency, requires a high formability.

Patent Document 1 discloses a titanium material in which projections and recesses high in density and large in depth are formed, which titanium material is obtained as a result that an oxide film and a nitride film are formed by heating in an oxidizing atmosphere or a nitrizing atmosphere, followed by bending or stretching to introduce minute cracks into these coating films to thereby expose metallic titanium, and thereafter melted and carved in a soluble acid aqueous solution. According to Patent Document 1, a securing property of lubricant oil is increased by forming the projections and recesses whose average roughness is larger and whose average interval is smaller than conventional ones, so that a lubricity of the titanium material is improved. Besides, the lubricity is further improved by leaving or forming the oxide film or the nitride film in a surface.

Patent Document 2 discloses a titanium sheet in which a difference between a Vickers hardness at a load of 0.098 N and a measurement value at a load of 4.9 N is 20 or more, which titanium sheet is obtained as a result of making a Vickers hardness at a load of 4.9 N be 180 or less by annealing a cold-rolled titanium sheet in an atmosphere controlled to have an oxygen partial pressure of a predetermined range. Thereby, decrease of a formability of the titanium sheet itself is averted and hardening only a surface layer prevents seizing at the time of pressing, so that the formability of the titanium sheet is improved.

Patent Document 3 discloses a titanium thin sheet excellent in formability whose surface hardness at a load of 200 gf (1.96 N) is made to be 170 or less and a thickness of whose oxide layer is made to be 150 Å or more, which titanium thin sheet is obtained as a result that a portion of 0.2 μm is removed chemically or mechanically from a surface of a titanium thin sheet to thereby eliminate residual oil burnt on the surface at the time of cold-rolling, followed by vacuum annealing. According to a method of Patent Document 3, since a hardened layer is not formed in a surface layer of the titanium thin sheet, a formability of a material is not impaired and a lubricity between a die and a tool at the time of forming is maintained, so that a formability of the titanium thin sheet is improved.

Patent Document 4 discloses a titanium sheet whose formability is improved by performing acid pickling after atmosphere annealing to thereby make a difference between a surface Vickers hardens at a load of 0.098 N and a Vickers hardness at a measurement load of 4.9 N be 45 or less. Besides, it is disclosed that adjusting a surface shape of a titanium sheet by skin pass rolling after acid pickling improves an oil retention property, to thereby improve seizure resistance.

Patent Document 5 discloses a technology, related to a titanium material for fuel cell separator, of forming a surface layer where chemical compounds of O, C, N or the like and Ti mixedly exist by cold-rolling a titanium original sheet which has been annealed using organic rolling oil, followed by a heat treatment, to thereby reduce a contact resistance.

Patent Document 6 discloses a technology of suppressing seizing between a titanium sheet and a rolling roll by forming an oxide coating film in a surface of a titanium sheet before cold-rolling of the titanium sheet.

PRIOR ART DOCUMENT

Patent Document

[Patent Document 1] Japanese Laid-open Patent Publication No. 2005-298930

[Patent Document 2] Japanese Laid-open Patent Publication No. 2002-3968

[Patent Document 3] Japanese Laid-open Patent Publication No. 2002-194591

[Patent Document 4] Japanese Laid-open Patent Publication No. 2010-255085

[Patent Document 5] International Publication No. 2014/156673

[Patent Document 6] Japanese Patent Publication No. S60-44041

SUMMARY OF THE INVENTION

Problems to be Solved by the Invention

Patent Document 1 discloses a technology of forming the highly dense projections and recesses in the surface, but does not disclose a relationship with a formability.

The technology of Patent Document 2 is inferior in simplicity since it is necessary to control the oxygen partial pressure at the time of annealing. It is quite difficult to hold the oxygen partial pressure at a constant pressure by discharging of gas from a furnace material at the time of vacuum annealing.

The technology of Patent Document 3 requires mechanical or chemical removing of the residual oil on the surface at the time of cold-rolling, and is inferior in productivity and yield.

The technology of Patent Document 4 requires removing one of the surfaces by about 10 μm or more in order to make the difference in hardness between the surface and a base material be 45 or less, which reduces a yield. Besides, since acid pickling is essential, an oxide coating film or a hard layer does not exist in the surface, so that seizure resistance of the material itself is bad.

In Patent Documents 3 and 4, the surface is softened in order for improvement of a formability of the titanium sheet, and occurrence of a crack at the time of forming is suppressed, but stress concentration occurs in low-frequency cracks generated as forming proceeds, which enhances localized necking.

In the technology of Patent Document 5, a hard layer is distributed locally as deep as 10 μm or more when viewed from an uppermost surface, and a carbon concentrated layer comes to have a depth of 10 μm. Thus, it is difficult to achieve a high formability.

Since the technology of Patent Document 6 focuses on prevention of seizing between the titanium sheet and the rolling roll, a formability of the titanium sheet is not considered. As a matter of course, there is no technical suggestion about the means for improving the formability of the titanium sheet.

The present invention is made to solve the problems of the conventional technologies described above, and its object is to provide a titanium sheet exhibiting an excellent formability which is obtained, without complicated process steps, as a result of generating a large number of minute cracks in a surface in a forming process by stably forming a thin and hard layer uniformly in the surface to thereby alleviate stress concentration at the time of forming.

Means for Solving the Problems

For producing a titanium sheet of the present invention, there is suitably used industrial pure titanium used for forming, namely, JIS1, JIS2, ASTM Gr.1, Gr.2 equivalent thereto, or the like. Further, ASTM Gr.16, Gr.17, Gr.30, Gr.7 (corrosion resistant titanium alloy such as Ti-0.05Pd, Ti-0.06Pd, Ti-0.05Pd-0.3CoTi-0.15Pd) can also be used for the titanium sheet of the present invention.

For evaluation of a formability of a sheet material, an Erichsen test, which is comparatively simple, is generally used. The Erichsen test is normally carried out with solid or liquid lubricant oil being used as a lubricant. Many examples exist in which evaluation is done under the above lubricating condition. However, since directions in which deformation occurs differ depending on dies in actual forming such as press work, there is a possibility that a press workability of a material cannot be evaluated by evaluation of the formability close to equal biaxial deformation as in the Erichsen test.

Generally, the most severe deformation of a titanium sheet is plane strain deformation. Thus, in order to evaluate a formability in plane strain deformation being the most severe deformation, the present inventors evaluated the formability by a ball head bulging test using a specimen shape capable of simulating plane strain deformation. Thereby, it became possible to evaluate the formability in the most severe deformation of the material, bringing about evaluation of the formability closer to the actual forming by pressing.

The present inventors considered that a press formability of the titanium sheet is substantially related to a surface property, that is, for example, a surface hardness and a surface shape, in addition to a metal structure.

Thus, in order to accurately obtain information of the hardness of an uppermost surface layer of the titanium sheet, measurement of a surface Vickers hardness when loads are varied between 0.245 N (25 gf) and 9.8 N (1000 gf) was attempted. In Vickers hardness measurement, an indentation depth of a Vickers indenter can be changed by varying the loads. Since the indentation depth of the Vickers indenter is small at an ultra-low load such as 0.245 N, the hardness of the uppermost surface layer portion of the titanium sheet can be evaluated. In contrast, the indentation depth is large at a load as high as 9.8 N, so that the hardness of the material can be evaluated. Further, regarding a surface state of the titanium sheet, surface irregularities and a state of a crack in the surface after a forming test were observed in detail.

As a result of a keen study on a surface property exhibiting an excellent formability, the present inventors found out that occurrence of numerous minute surface cracks in a surface in a forming process improves the formability. More specifically, it was found that in the bulging forming process which simulates plane strain deformation described above, an average interval of cracks generated in the surface is less than 50 μm when a strain is given 25% in a rolling direction and that a formability is improved when a depth of the crack is 1 μm or more and less than 10 μm.

It was found that in order to obtain such cracks, it is necessary to make the Vickers hardness of the surface of the titanium sheet have a proper value and that the above can be realized by forming a carbon concentrated layer in which carbon is concentrated in the surface. As a result that numerous minute cracks are generated in the carbon concentrated layer having the proper hardness as above in a forming process, there occurs an effect that stress-concentrated places in the titanium sheet surface are dispersed.

The present inventors further conducted a keen study on a manufacturing method for obtaining the above-described surface hardness and carbon concentrated layer uniformly and stably. As a result, it was found that making a condition of a cold-rolling step and a condition of an annealing step be appropriate is important in order to obtain the above-described surface hardness and carbon concentrated layer.

The present invention is made in view of the above findings and the gist thereof is described below.

(1) A titanium sheet, wherein, when a carbon concentration of a base material is $C_b$ (mass %) and a carbon concentration at a depth d from a surface is $C_d$ (mass %), the depth d (carbon concentrated layer thickness) satisfying $C_d/C_b>1.5$ is 1.0 μm or more and less than 10.0 μm, wherein a Vickers hardness $HV_{0.025}$ at a load of 0.245 N in the surface is 200 or more, a Vickers hardness $HV_{0.05}$ at a load of 0.49 N in the surface is lower than $HV_{0.025}$, and a difference between $HV_{0.025}$ and $HV_{0.05}$ is 30 or more, wherein a Vickers hardness $HV_1$ at a load of 9.8 N in the surface is 150 or less, and wherein an average interval between cracks generated in the surface when a strain of 25% is given in a rolling direction in a bulging forming process is less than 50 μm and a depth thereof is 1 μm or more and less than 10 μm.

(2) A method for manufacturing the titanium sheet of aforementioned (1), the manufacturing method consisting of: after performing hot-rolling and descaling, forming an oxide coating film of 20 to 200 nm in thickness in a titanium sheet; performing cold-rolling to the titanium sheet by using mineral oil as lubricant oil at a reduction ratio of 15% or more per each pass until a rolling ratio of 70% is reached; thereafter, performing cold-rolling at a reduction ratio of 5% or less at least in a final pass; and performing annealing to the cold-rolled titanium sheet by holding in a temperature range of 750 to 810° C. for 0.5 to 5 minutes in a vacuum or Ar gas atmosphere.

Effect of the Invention

According to the present invention, it is possible to form a thin and hard carbon concentrated layer uniformly in a surface of a titanium sheet. Thereby, it is possible to provide a titanium sheet exhibiting an excellent formability brought about by alleviation of stress concentration at the time of forming as a result that numerous minute cracks are generated in the surface in a forming process. This titanium sheet, since being excellent in formability, is particularly useful as a material for a heat exchanger in a chemical plant, an electric power plant and a food manufacturing plant, for example.

MODES FOR CARRYING OUT INVENTION

Hereinafter, embodiments of the present invention will be described.

(1) Titanium Sheet (1-1) Surface minute crack: Regarding cracks generated in a surface when a strain is given 25% in a rolling direction, an average interval between the cracks is less than 50 and a depth of the crack is 1 μm or more and less than 10 μm:

In the titanium sheet according to the present invention, the average interval of cracks generated in the surface when the strain is given 25% in the rolling direction in a bulging forming process being plane strain deformation is less than 50 and a depth of the crack is 1 μm or more and less than 10 μm. Thereby, stress concentration on a crack tip portion at the time of forming is alleviated and progress of localized necking of a material can be prevented, resulting in improvement of a formability. In a case where such minute cracks are not generated, low-frequency coarse cracks are generated as forming progresses, stresses are concentrated on the coarse cracks, which causes localized necking to thereby deteriorate the formability.

The average crack interval in this application is defined by a value obtained from a formula (1) below after a surface profile is monitored 200 μm in a direction parallel to the rolling direction by using a laser microscope VK9700 manufactured by KEYENCE CORPORATION to measure the number of projections and recesses of 1 μm or more in depth.

$$I=L/N \quad (1)$$

Figure 1:
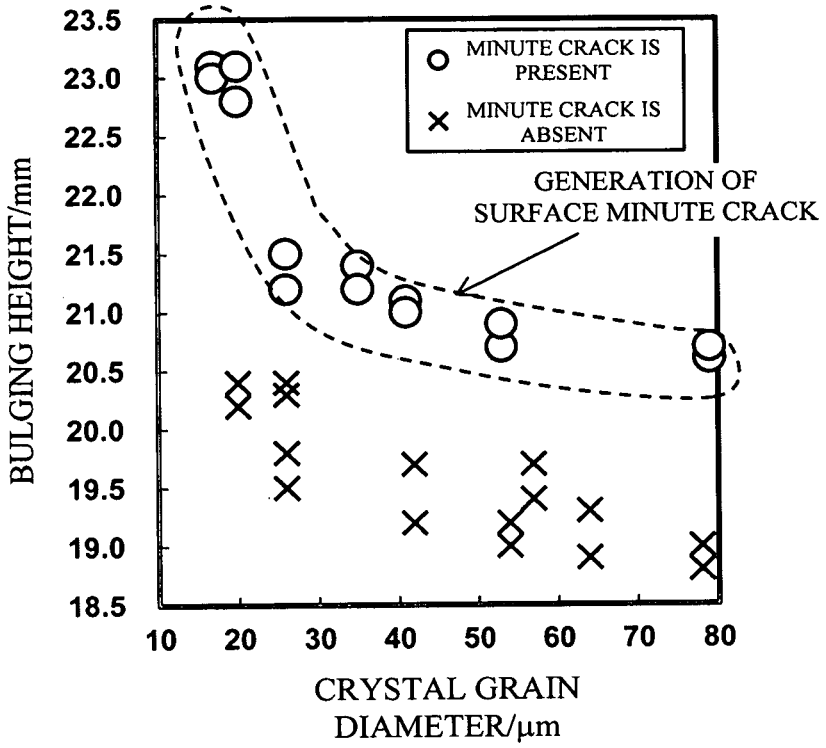
FIG. 1 is a chart illustrating a relationship between a crystal grain diameter and a bulging height after a ball head bulging test.

I: average crack interval, L: measured length, N: number of projections and recesses of 1 μm or more in depth Hereinafter, the surface cracks whose average interval is less than 50 μm and whose depth is 1 μm or more and less than 10 μm are referred to as "minute cracks". FIG. 1 illustrates a relationship between a crystal grain diameter being a metal structure property which considerably influences the formability and a bulging height in the above-described ball head bulging test. As illustrated in FIG. 1, even if the crystal grain diameters are the same, a formability vary considerably depending on presence and absence of generation of the minute crack in the surface after forming. The crystal grain diameter is a property contributing to ductility of titanium and when the crystal grain diameter is 15 to 80 a formability is superior.

(1-2) Surface Vickers hardness: $HV_{0.025}$ is 200 or more, $HV_{0.05}$ is lower than $HV_{0.025}$, a difference therebetween is 30 or more, and $Hv_1$ is 150 or less:

In the titanium sheet according to the present invention, the Vickers hardness $HV_{0.025}$ in the surface at a load of 0.245 N is 200 or more and the Vickers hardness $HV_{0.05}$ in the surface at a load of 0.49 N is lower than $HV_{0.025}$, and the difference therebetween is 30 or more. In other words, a hard layer is formed only in a very shallow surface layer. Satisfying the surface Vickers hardness as above enables generation of the above-described minute cracks in the surface of the titanium sheet when the strain of 25% is applied in the rolling direction. Further, it is necessary that the Vickers hardness $V_1$ at 9.8 N being a high load is 150 or less in order to secure the formability of the material.

When the difference between $HV_{0.025}$ and $HV_{0.05}$ is less than 30, that is, when the hard layer is formed deeply, coarse cracks are generated due to largeness of the depth of the surface crack to be generated and the formability is adversely affected. Further, when $HV_{0.025}$ is lower than 200, the surface crack at the time of forming is suppressed, but as forming progresses, low-frequency surface cracks are generated to thereby hinder alleviation of stress concentration on a crack portion, so that a good formability cannot be obtained. When $HV_1$ exceeds 150, ductility of the material itself is reduced and a good formability cannot be obtained.

(1-3) Carbon concentrated layer thickness: depth d satisfying $C_d/C_b>1.5$ is 1.0 μm or more and less than 10.0 μm:

In the titanium sheet according to the present invention, it is necessary that the depth satisfying $C_d/C_b>1.5$ (hereinafter, referred to as the "carbon concentrated layer thickness") d is 1.0 μm or more and less than 10.0 μm when a carbon concentration of a base material is indicated by $C_b$ (mass %) and a carbon concentration at a depth d μm from the surface is indicated by $C_d$ (mass %).

In the present invention, the surface Vickers hardness is adjusted by concentrating carbon on the surface layer of the titanium sheet. When the carbon concentrated layer thickness is 1.0 μm or more and less than 10.0 μm, the above-described surface Vickers hardness can be obtained. When the carbon concentrated layer thickness is 10.0 μm or more, $HV_{0.05}$ becomes high and the difference with $HV_{0.025}$ cannot be made to be 30 or more, resulting in that desired minute cracks cannot be generated and that coarse cracks are generated in the surface, so that the formability of the titanium sheet is deteriorated. In a case where the carbon concentrated layer thickness is less than 1.0 μm, it is impossible to make $HV_{0.025}$ be 200 or more.

(1-4) Metal structure: average crystal grain diameter of α phase:

In the titanium sheet according to the present invention, the average crystal grain diameter of the α phase is preferably 15 to 80 μm. When the α crystal grain diameter is less than 15 μm, ductility of the material is reduced and the formability is likely to be deteriorated. When the average crystal grain diameter of the α phase is larger than 80 μm, it is apprehended that press working or the like causes a rough surface. Regarding projections and recesses of the surface generated due to the rough surface, the larger the crystal grain diameter is, the larger the depths and intervals become. When the crystal grain diameter exceeds 80 μm, the depth of the crack generated in the surface becomes 10 μm or more or the average interval between the cracks becomes 50 μm or more, which deteriorates the formability.

(2) Manufacturing Method

In manufacturing the titanium sheet according to the present invention by carrying out a melting step, a blooming and forging step, a hot-rolling step, a cold-rolling step, and a vacuum or Ar gas atmosphere annealing step, it is important to form an oxide coating film of 20 to 200 nm in thickness after hot-rolling and descaling as well as to ensure proper conditions for the cold-rolling step and the vacuum or Ar gas atmosphere annealing step.

(2-1) Melting step, blooming and forging step, hot-rolling step

The melting step, the blooming and forging step and the hot-rolling step can be performed under normal conditions without particular constraint. After the hot-rolling step, scales are removed by an acid pickling treatment. A sheet thickness of the titanium sheet after the hot-rolling step is preferably 4.0 to 4.5 mm in view of the processing of the subsequent step.

After the scales are removed by the acid pickling treatment after the hot-rolling step, the oxide coating film of 20 to 200 nm in thickness is formed. The oxide coating film of 20 to 200 nm in thickness formed before cold-rolling prevents "scuffed rough surface (having minute recesses and overlapping)" caused by a seizing phenomenon occurring between a roll and the titanium sheet at the time of cold-rolling. The scuffed rough surface is notably seen in a titanium sheet. Note that a natural oxide coating film is formed in a surface to which the acid pickling treatment has been applied after the hot-rolling step, and a thickness thereof is about 5 to 10 nm, for example.

Examples of a method for forming the oxide coating film of 20 to 200 nm in thickness as above include a heating processing in the atmosphere and an anodic oxidation processing. In the heating processing in the atmosphere, the thickness of the oxide coating film can be adjusted by a temperature and a time period of heating. The heating processing temperature of 350 to 650° C. is suitable. When the heating processing temperature is lower than 350° C., the time period for forming the oxide coating film becomes long. Meanwhile, when the heating processing temperature exceeds 650° C., denseness of the oxide coating film formed in the surface of the titanium sheet is reduced and the oxide coating film is sometimes worn or peeled partially during cold-rolling. In the anodic oxidation processing, with the titanium sheet being an anode, a voltage of 20 to 130 V is applied in conductive liquid such as a phosphoric acid aqueous solution to thereby form an oxide coating film. Industrially, it is possible to form an oxide coating film by using a line of electrolytic cleaning or electrolytic acid pickling.

In a case of the titanium sheet in which the oxide coating film as above is formed in the surface, a friction coefficient measured by a pin-on-disk tester under a condition that lubricant oil is not used is 0.12 to 0.18 when a tool steel SKD 11 pin is used as a pin of the tester, and 0.15 to 0.20 when an industrial titanium JIS 1-type pin is used. Meanwhile, in a case of pure titanium sheet in which an oxide coating film is not formed, a friction coefficient is 0.30 to 0.40 when the tool steel SKD 11 pin is used, and 0.34 to 0.44 when the industrial titanium JIS 1-type pin is used. In other words, the titanium sheet in which the above-described oxide coating film is formed in the surface has a friction coefficient of about half the friction coefficient of the pure titanium sheet in which the oxide coating film is not formed. Measurement of the friction coefficient under the condition that the lubricant oil is not used is measurement on the assumption that a lubricant oil film is locally interrupted during rolling, for example. Therefore, in the titanium sheet in which the above-described oxide coating film is formed in the surface, the friction coefficient to SKD 11 which is equivalent to steel being a roll material is low, and thus a scuffed rough surface is notably suppressed.

Meanwhile, since the surface of the titanium sheet is somewhat worn at the time of cold-rolling, wear debris of titanium are mixed in the lubricant oil. The present inventors have newly found that sticking of the wear debris on the titanium sheet surface impairs a lubricity by the oxide coating film to thereby induce occurrence of a scuffed rough surface. In order to suppress occurrence of such a scuffed rough surface, friction to the titanium sheet is required to be small, and if the oxide coating film of 20 to 200 nm in thickness is formed in the surface of the titanium sheet, a stable low friction coefficient can be obtained. As cold-rolling oil used for a lubricity, it is preferable to use one making a contact angle be about 15° in an acid pickled surface in which an oxide coating film is not formed and making a contact angle be about 5 to 10° in a surface in which an oxide coating film of 20 to 200 nm in thickness is formed, for example. The above increases a wettability to thereby enhance uniformity of a surface skin, so that an effect of suppressing a scuffed rough surface is improved.

(2-2) Cold-rolling step, vacuum or Ar gas atmosphere annealing step

In manufacturing the titanium sheet according to the present invention, cold-rolling at a high load is first performed in the cold-rolling step. More specifically, rolling until reaching a rolling ratio of 70% in cold-rolling is performed at a reduction ratio of 15% or more per each pass. In rolling reduction of each pass, in a case where the rolling ratio is less than 70% after finishing of rolling reduction in one pass and the rolling ratio exceeds 70% in rolling reduction in the next pass, it is not necessarily required to make the reduction ratio be 15% or more in the pass whose rolling ratio exceeds 70% by rolling reduction for the first time. In other words, for rolling until reaching the rolling ratio of 70%, it suffices that the reduction ratio per each pass is 15% or more for passes just before the pass whose rolling ratio exceeds 70% for the first time after finishing of the rolling reduction.

If rolling is performed at the reduction ratio of less than 15% per each pass until the rolling ratio reaches 70%, that is, rolling is performed at a low load, TiC is not formed sufficiently in the surface, so that a carbon concentrated layer is not formed in subsequent annealing in a vacuum or Ar gas atmosphere. In view of forming TiC of a sufficient amount more stably in the surface, it is preferable that the reduction ratio per each pass is 20% or more until the rolling ratio reaches 70%.

After the rolling ratio of the titanium sheet reaches 70%, cold-rolling is continued while the reduction ratio of each pass is appropriately set until the desired rolling ratio is obtained, and at least in the final pass, cold-rolling is performed at a reduction ratio of 5% or less, namely, the reduction ratio of over 0% to 5%. In the surface of the titanium sheet rolled here, in addition to TiC having formed by rolling until that time, mineral oil being lubricant oil at the time of rolling remains as a carbon source. This is what is called attached oil. By performing cold-rolling to such attached oil at the reduction ratio of 5% or less in the final pass, the attached oil is spread over the titanium sheet surface and distribution of the attached oil being the carbon source is uniformized in the titanium sheet surface.

On the other hand, if the reduction ratio in the final pass exceeds 5%, work hardening of the titanium sheet progresses by cold-rolling and slipping sometimes occurs between the hard titanium sheet surface and the rolling roll to thereby make the titanium sheet surface rubbed, bringing about prominent abrasion. In this case, a portion in which remaining carbon amounts are non-uniform is formed locally in the titanium sheet surface, and there is sometimes a case where a carbon concentrated layer according the present invention cannot be obtained after later-described annealing. Further, there is a possibility that a mark is formed in the titanium sheet surface. Thus, it is necessary to make the reduction ratio of rolling performed in the final pass of the cold-rolling step be 5% or less. Note that allotment (pass schedule) of the rolling ratio is not particularly restricted except the reduction ratio until reaching the rolling ratio of 70% and the reduction ratio in the final pass as described above. For example, if the reduction ratio of each pass until the rolling ratio reaches 70% is 15% or more, the reduction ratio of each pass may be different from each other. Further, if the reduction ratio of the final pass is 5% or less, the reduction ratio in the rolling pass other than the final pass among the rolling passes after the rolling ratio has reached 70% may exceed 5%. After the rolling ratio exceeds 70%, in view of holding flatness of a sheet to be rolled, a pass schedule is suitable in which the reduction ratios are allotted in a manner that the reduction ratio of each pass is reduced in stages in a range of less than 15% and that the reduction ratio becomes 5% or less in the final pass.

Generally, lubricant oil is used at the time of cold-rolling. In the method for manufacturing the titanium sheet according to the present invention, mineral oil is used as the lubricant oil. By performing the above-described cold-rolling, carbon contained in the mineral oil reacts to titanium to form TiC in the surface and carbon in TiC in the surface is dispersed toward the inside of the titanium sheet during the vacuum or Ar gas atmosphere annealing, so that the carbon concentrated layer can be formed to thereby bring about the titanium sheet according to the present invention.

The reason for using the mineral oil as the lubricant oil is that a major constituent of the mineral oil is hydrocarbon-based and that the carbon constituent in the mineral oil becomes a supply source of carbon to the carbon concentrated layer. When rolling oil which does not contain carbon or whose carbon content is small, such as emulsion oil and silicon oil, for example, is used as the lubricant oil, TiC does not remain in the surface, and a predetermined carbon concentrated layer is not formed even by later-described annealing in the vacuum or Ar gas atmosphere.

A titanium sheet produced after hot-rolling and the scale removal step such as acid pickling normally has a recess and an overlapping with a depth as large as several μm formed in the surface by cold-rolling (the recess and the overlapping with the depth as large as several μm in the surface as above are referred to as a "scuffed rough surface"), and the lubricant oil intrudes into the inside of the scuffed rough surface and remains at the time of cold-rolling. In other words, as a result that the large amount of lubricant oil being the carbon source is locally distributed in a portion (in the recess and the overlapping) several μm lower directly under the surface, carbon is diffused further inside at the time of annealing after the cold-rolling, so that a hard layer is locally distributed to 10 μm or more in depth when viewed from the uppermost surface, bringing about the carbon concentrated layer of 10 μm or more. In a conventional manufacturing method, since portions of 10 μm or more as above locally exist, a comparatively large crack is generated at the time of forming and stress concentration thereon occurs, so that a high formability was not able to be attained. Since the lubricant oil having intruded into the inside of the scuffed rough surface intrudes into a very narrow gap, the lubricant oil is left inside the gap even in a cleaning process using alkali or the like after the cold-rolling. The lubricant oil having remained as above can be removed by acid pickling, but deterioration of TiC or the remaining oil in the surface is induced, resulting in difficulty in obtaining a desired carbon concentrated layer.

According to the present invention, by the oxide coating film of 20 to 200 nm in thickness formed before the cold-rolling, the wettability of the lubricant oil is increased and the oxide coating film acts as a barrier between the roll and metallic titanium, so that severe seizing to lead to the scuffed rough surface is suppressed prominently. Consequently, after the annealing, it is possible to obtain a titanium sheet having a predetermined surface carbon concentration and a predetermined surface hardness which are prescribed above. If a thickness of the oxide coating film formed before the cold-rolling is less than 20 nm, the above-described effect is insufficient because the oxide coating film is thin, and if the thickness is larger than 200 nm, an amount of TiC formed by reaction of the lubricant oil to the metallic titanium becomes small, so that $HV_{0.025}$ of 200 or more cannot be obtained. Note that the thickness of the oxide coating film formed before the cold-rolling is preferably 30 to 100 nm.

After the above-described cold-rolling is performed, annealing by holding in a temperature range of 750 to 810° C. for 0.5 to 5 minutes is performed in a vacuum or Ar gas atmosphere. Between the cold-rolling step and the annealing step, a cleaning step by alkali (an aqueous solution whose major constituent is sodium hydroxide) is provided. In the surface of the titanium sheet after the cold-rolling, the lubricant oil which can be easily removed by wiping with a waste cloth is attached inevitably, but the lubricant oil sometimes gathers in a non-flat waveform portion in the titanium sheet surface. Performing the cleaning step by alkali to such lubricant oil enables removal of the lubricant oil which remains inevitably. Consequently, it is possible to suppress a carbon concentrated layer with a carbon concentration exceeding a predetermined carbon concentration due to existence of an excessive carbon source from being formed locally. In other words, by performing the cleaning step, the carbon concentrated layer can have a predetermined thickness, resulting in that a surface Vickers hardness can have a predetermined value.

When a temperature at the time of annealing is lower than 750° C., holding for a long period of time is required for the sake of obtaining a metal structure (crystal grain diameter) suitable to a formability, and in such a case, a carbon concentration thickness becomes large, making it impossible to obtain the titanium sheet according to the present invention. When the temperature at the time of annealing is higher than 810° C., a β phase being a second phase precipitates into titanium, making it difficult to control the metal structure.

Further, when the annealing is performed in the atmosphere, an oxide scale is generated in the surface, and thus an acid pickling step thereafter is essential, resulting in that the carbon concentrated layer in the surface is removed.

Therefore, in the manufacturing method for the titanium sheet according to the present invention, by performing the aforementioned cold-rolling step and the annealing step in the vacuum or Ar atmosphere under conditions of the high temperature and short-time holding, the carbon concentrated layer can be formed uniformly and stably in the surface of the titanium sheet. Thereby, it is possible to generate numerous minute cracks in the surface in the subsequent forming steps. Consequently, it becomes possible to uniformly alleviate stress concentration at the time of forming, so that the formability of the titanium sheet can be improved.

Note that when a cold-rolled sheet is annealed, an average crystal grain diameter of an α phase is determined by an annealing temperature and a holding time period. At the annealing temperature prescribed in the present invention, making the holding time period be 0.5 to 5 minutes enables the average crystal grain diameter of the α phase to fall within the preferable range described above.

Example 1

Hereinafter, an effect of the titanium sheet of the present invention will be described by way of examples. As a sample sheet, there was used a titanium sheet of 4.5 mm in thickness fabricated by bloom-rolling and hot-rolling a titanium JIS-1 type ingot having been electron-beam melted and thereafter performing an acid pickling treatment using nitric hydrofluoric acid. The steps of a1) to a4) described below were applied to the titanium sheet in sequence, to thereby fabricate a titanium sheet for test as a sheet of the present invention (sample sheets No. A1 to No. A14).

a1) Step of forming oxide coating film of 20 to 200 nm in thickness after acid pickling treatment In this step, an oxidation processing was performed to each sample sheet at 500° C. in the atmosphere for three minutes. A thickness of the oxide coating film formed at that time was 72 nm. Further, a distribution of oxygen concentrations in a depth direction of the titanium sheet in a titanium sheet surface was measured by using a glow discharge optical emission spectrometer (GDS), and from that concentration distribution, there was obtained a depth at the time that a value (oxygen concentration of a base material) of when the oxygen concentration decreasing along a depth direction was stabilized became half the maximum value of the oxygen concentration in a vicinity of the surface, and the depth was defined as a thickness of the oxide coating film.

a2) Cold-rolling step of performing rolling at reduction ratio of 15% or more per each pass until rolling ratio reaches 70%, thereafter performing rolling at reduction ratio of 5% or less at least in final pass until rolling ratio reaches 89%

In this example, the reduction ratio per each pass from the time of the rolling ratio of 70% until the previous pass of the final pass was set to less than 15%.

a3) Cleaning step performed with alkali (in aqueous solution whose major constituent is sodium hydroxide)

a4) Vacuum or Ar gas atmosphere annealing step of holding in temperature range of 750 to 810° C. for 0.5 to 5 minutes Comparative sheets below were fabricated in addition to the sample sheets in the present invention.

Comparative sheet I: titanium sheets for test (sample sheets No. A15 to No. A22) subjected to annealing described in aforementioned step a4) after subjected to cold-rolling at reduction ratio of less than 15% per each pass until rolling ratio of 70%

Comparative sheet II: titanium sheets for test (sample sheets No. A23 to A28) subjected to annealing of holding in temperature range of 600 to 700° C. in vacuum for 240 minutes after subjected to aforementioned steps a1), a2) and a3)

Comparative sheet III: titanium sheets for test (sample sheets No. A29 and No. A30) subjected to annealing described in aforementioned step a3) after subjected to cold-rolling in which reduction ratio of final pass exceeds 5%

There were evaluated, for each sample sheet, an average crystal grain diameter, a formability, a surface state after a forming test, a surface Vickers hardness and a carbon concentrated layer thickness, under conditions described below.

Average Crystal Grain Diameter

In a structure photograph taken by an optical microscope, an average crystal grain diameter of an α phase was calculated by an intercept method based on JIS G 0551 (2005).

Formability

A titanium sheet was processed into a shape of 70 mm×95 mm to have plane strain deformation by using a ball head punch of ϕ40 mm by a deep drawing testing machine SAS-350D manufactured by TOKYO KOKI TESTING MACHINE CO., LTD. and a ball head bulging test was performed. Note that a specimen was processed to be 95 mm in a rolling direction.

Bulging forming was evaluated by comparing bulging heights when the specimens were fractured, after high-viscosity oil (#660) manufactured by NIHON KOH-SAKUYU CO., LTD. was applied and a poly sheet was put thereon to prevent the punch and the titanium sheet from being in contact with each other. The sample sheet whose bulging height was 20.5 mm or more in the ball head bulging test was judged to be a titanium sheet exhibiting an excellent formability.

Surface State after Forming Test

For a surface of the specimen after the ball head bulging test, a surface profile was monitored as far as 200 μm in a direction parallel to a rolling direction and the number of projections and recesses of 1 μm in depth was measured by using a laser microscope VK9700 manufactured by KEYENCE CORPORATION, and then an average crack interval was obtained by the aforementioned formula (1). Further, surface observation after the forming test was performed by using a SEM, namely, VHX-D510 manufactured by KEYENCE CORPORATION.

Surface Vickers Hardness

A Vickers hardness of the titanium sheet was each measured at a load of 0.245 N (25 gf), 0.49 N (50 gf) and 9.8 N (1000 gf) by a micro Vickers hardness testing machine MVK-E manufactured by Akashi Corporation.

Carbon Concentrated Layer Thickness

A carbon concentrated layer distribution in a direction in a depth direction from a surface was measured by using a glow discharge optical emission spectrometer GDA 750A manufactured by Rigaku Corporation. Even if the depth was larger than that, a concentration value at the time that a predetermined carbon concentration is obtained was defined as a carbon concentration of a base material. Here, with a carbon concentration of the base material being $C_b$ (mass %) and a carbon concentration of a depth d μm from the surface being $C_d$ (mass %), the depth d satisfying $C_d/C_b>1.5$ was defined as a carbon concentrated layer thickness.

Evaluation results of the above are listed together with manufacturing conditions in Table 1. Further, as an example of minute cracks in the surface, FIG. 2(*a*) illustrates a surface profile measurement result after the ball head bulging test of the sample sheet No. A4 and FIG. 2(*b*) illustrates that of the sample sheet No. A24. Further, FIG. 3(*a*) illustrates a surface SEM image after the ball head bulging test of the sample sheet No. A4 and FIG. 3(*b*) illustrates that of the sample sheet No. A24.

TABLE 1

| No. | ANNEALING CONDITION TEMPERATURE (° C.) | ANNEALING CONDITION TIME (min) | CRYSTAL GRAIN DIAMETER (μm) | $HV_{0.025}$ | $HV_{0.05}$ | $HV_1$ | DIFFERENCE BETWEEN $HV_{0.025}$ AND $HV_{0.05}$ | CARBON CONCENTRATED LAYER THICKNESS (μm) | BULGING HEIGHT (mm) | PRESENCE/ABSENCE OF MINUTE CRACK*1 | FORMABILITY*2 | REMARKS |
|---|---|---|---|---|---|---|---|---|---|---|---|---|
| A1 | 780 | 0.5 | 17 | 201 | 166 | 118 | 35 | 3.0 | 23.1 | PRESENT | ○ | SHEET OF PRESENT INVENTION |
| A2 | 780 | 0.5 | 17 | 201 | 166 | 118 | 35 | 3.0 | 23.0 | PRESENT | ○ | SHEET OF PRESENT INVENTION |
| A3 | 770 | 1 | 20 | 243 | 177 | 121 | 66 | 4.3 | 22.8 | PRESENT | ○ | SHEET OF PRESENT INVENTION |
| A4 | 770 | 1 | 20 | 243 | 177 | 121 | 66 | 4.3 | 23.1 | PRESENT | ○ | SHEET OF PRESENT INVENTION |
| A5 | 800 | 1 | 26 | 236 | 202 | 122 | 34 | 4.8 | 21.2 | PRESENT | ○ | SHEET OF PRESENT INVENTION |
| A6 | 800 | 1 | 26 | 236 | 202 | 122 | 34 | 4.8 | 21.5 | PRESENT | ○ | SHEET OF PRESENT INVENTION |
| A7 | 800 | 3 | 41 | 260 | 215 | 126 | 45 | 6.2 | 21.1 | PRESENT | ○ | SHEET OF PRESENT INVENTION |
| A8 | 800 | 3 | 41 | 260 | 215 | 126 | 45 | 6.2 | 21.0 | PRESENT | ○ | SHEET OF PRESENT INVENTION |
| A9 | 800 | 5 | 53 | 270 | 223 | 132 | 47 | 8.6 | 20.7 | PRESENT | ○ | SHEET OF PRESENT INVENTION |
| A10 | 800 | 5 | 53 | 270 | 223 | 132 | 47 | 8.6 | 20.9 | PRESENT | ○ | SHEET OF PRESENT INVENTION |
| A11 | 810 | 1 | 35 | 242 | 201 | 124 | 41 | 5.0 | 21.4 | PRESENT | ○ | SHEET OF PRESENT INVENTION |
| A12 | 810 | 1 | 35 | 242 | 201 | 124 | 41 | 5.0 | 21.2 | PRESENT | ○ | SHEET OF PRESENT INVENTION |
| A13 | 810 | 5 | 79 | 276 | 227 | 134 | 49 | 9.2 | 20.6 | PRESENT | ○ | SHEET OF PRESENT INVENTION |
| A14 | 810 | 5 | 79 | 276 | 227 | 134 | 49 | 9.2 | 20.7 | PRESENT | ○ | SHEET OF PRESENT INVENTION |
| A15 | 790 | 1 | 20 | 183**3 | 156 | 122 | 27* | NO CONCENTRATION* | 20.2 | ABSENT* | X | COMPARATIVE SHEET I |
| A16 | 790 | 1 | 20 | 183* | 156 | 122 | 27* | NO CONCENTRATION* | 20.4 | ABSENT* | X | COMPARATIVE SHEET I |
| A17 | 800 | 1 | 26 | 191* | 170 | 125 | 21* | NO CONCENTRATION* | 19.8 | ABSENT* | X | COMPARATIVE SHEET I |
| A18 | 800 | 1 | 26 | 191* | 170 | 125 | 21* | NO CONCENTRATION* | 19.5 | ABSENT* | X | COMPARATIVE SHEET I |
| A19 | 800 | 5 | 54 | 210 | 199 | 128 | 11* | NO CONCENTRATION* | 19.2 | ABSENT* | X | COMPARATIVE SHEET I |
| A20 | 800 | 5 | 54 | 210 | 199 | 128 | 11* | NO CONCENTRATION* | 19.0 | ABSENT* | X | COMPARATIVE SHEET I |
| A21 | 810 | 5 | 78 | 218 | 204 | 125 | 14* | NO CONCENTRATION* | 18.8 | ABSENT* | X | COMPARATIVE SHEET I |
| A22 | 810 | 5 | 78 | 218 | 204 | 125 | 14* | NO CONCENTRATION* | 19.0 | ABSENT* | X | COMPARATIVE SHEET I |
| A23 | 630 | 240 | 26 | 204 | 189 | 123 | 15* | 11.2* | 20.4 | ABSENT* | X | COMPARATIVE SHEET II |

TABLE 1-continued

| No. | ANNEALING CONDITION TEMPERATURE (° C.) | ANNEALING CONDITION TIME (min) | CRYSTAL GRAIN DIAMETER (μm) | $HV_{0.025}$ | $HV_{0.05}$ | $HV_1$ | DIFFERENCE BETWEEN $HV_{0.025}$ AND $HV_{0.05}$ | CARBON CONCENTRATED LAYER THICKNESS (μm) | BULGING HEIGHT (mm) | PRESENCE/ABSENCE OF MINUTE CRACK*1 | FORMABILITY*2 | REMARKS |
|---|---|---|---|---|---|---|---|---|---|---|---|---|
| A24 | 630 | 240 | 26 | 204 | 189 | 123 | 15* | 11.2* | 20.3 | ABSENT* | X | COMPARATIVE SHEET II |
| A25 | 670 | 240 | 57 | 239 | 250 | 124 | −11* | 15.2* | 19.4 | ABSENT* | X | COMPARATIVE SHEET II |
| A26 | 670 | 240 | 57 | 239 | 250 | 124 | −11* | 15.2* | 19.7 | ABSENT* | X | COMPARATIVE SHEET II |
| A27 | 700 | 240 | 64 | 224 | 228 | 125 | −4* | 22.3* | 18.9 | ABSENT* | X | COMPARATIVE SHEET II |
| A28 | 700 | 240 | 64 | 224 | 228 | 125 | −4* | 22.3* | 19.3 | ABSENT* | X | COMPARATIVE SHEET II |
| A29 | 800 | 3 | 42 | 206 | 190 | 125 | 16* | NO CONCENTRATION* | 19.7 | ABSENT* | X | COMPARATIVE SHEET III |
| A30 | 800 | 3 | 42 | 206 | 190 | 125 | 16* | NO CONCENTRATION* | 19.2 | ABSENT* | X | COMPARATIVE SHEET III |

*1Evaluation of "PRESENT" was given to a sample sheet in which cracks of 1 to 9 μm in depth are generated at an average interval of less than 50 μm in a surface after bulging forming.
*2Regarding a formability, evaluation of ○ was given when a bulging height is 20.5 mm or more and evaluation of X was given when a bulging height is less than 20.5 mm.
*3A place with "*" means a place out of the range of the present invention.

Figure 2:
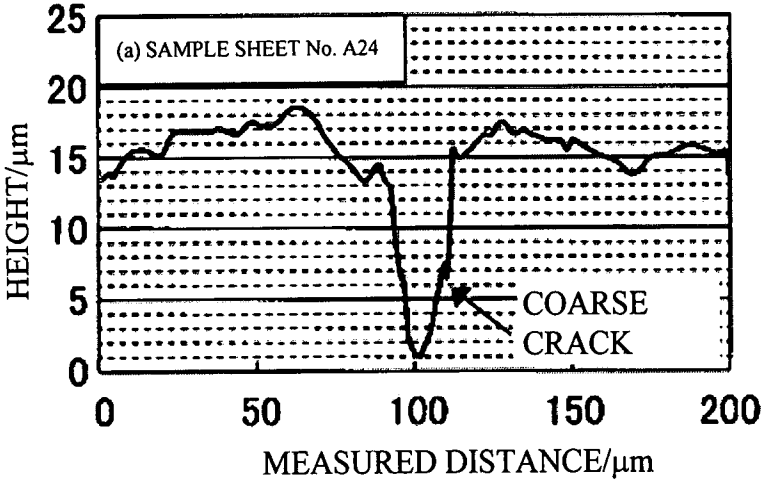
FIG. 2 illustrates instances of surface profile measurement results after ball head bulging tests in examples, (a) being that of the example of the present invention, and (b) being that of the comparative example.
Figure 2:
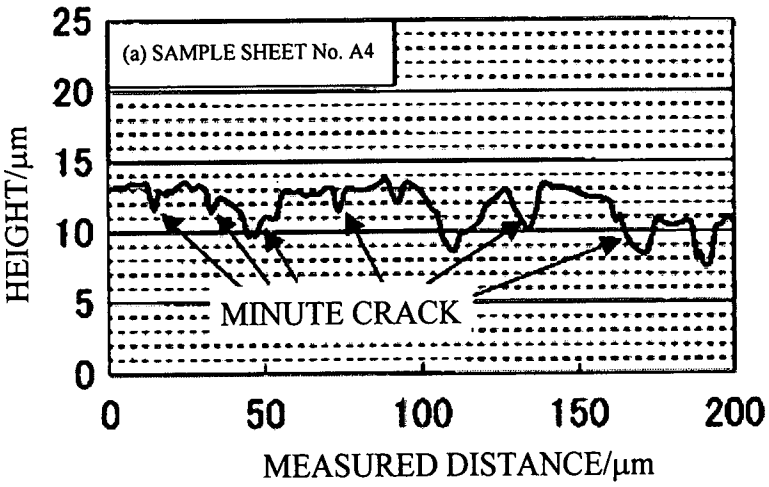
Figure 3:
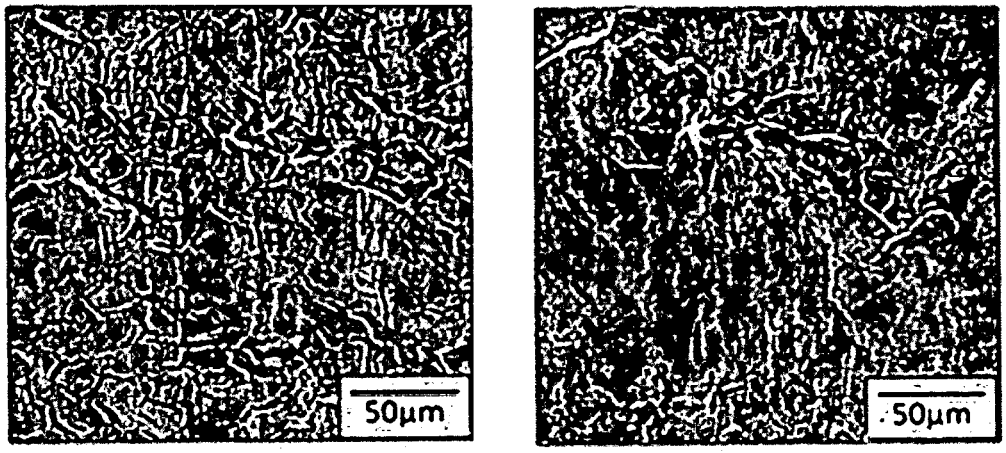
FIG. 3 illustrates instances of surface SEM images after ball head bulging tests in the examples, (a) being that of the example of the present invention, and (b) being that of the comparative example.

As illustrated in FIG. 2(*a*) and FIG. 3(*a*), in No. A4 being the sheet of the present invention, numeral minute cracks are generated in the surface in a forming process. On the other hand, in No. A24 being the comparative sheet, a minute crack is not generated in the surface but instead coarse cracks are generated.

In each of the sample sheets No. A1 to No. A14 equivalent to the present invention, minute cracks were generated in the surface in the forming process, and because of alleviation of stress concentration at the time of forming, there was exhibited an excellent formability of bulging height of 20.5 mm or more.

In each of No. A15 to No. A22 being the comparative sheets I, since a reduction ratio per each pass until reaching a rolling ratio of 70% was as small as less than 15%, a carbon concentrated layer was not formed, so that $HV_{0.025}$ was small Therefore, a minute crack was not generated in the surface in the forming process and stresses were concentrated on low-frequency cracks generated as forming progressed, resulting in an inferior formability.

Regarding each of No. A23 to No. A28 being the comparative sheets II, though a crystal grain diameter is satisfied, a holding time period at the time of annealing is long, leading to a carbon concentrated layer thickness of 10.0 μm or more, so that a difference between $HV_{0.025}$ and $HV_{0.05}$ is less than 30 or $HV_{0.05}$ is larger than $HV_{0.025}$. Thus, a coarse crack is generated in a surface at the time of forming and stress concentration is not alleviated, resulting in an inferior formability.

Regarding each of No. A29 and No. A30 being the comparative sheets III, since a reduction ratio of a final pass in a cold-rolling step exceeded 5%, a rolling roll slipped in a titanium sheet surface, resulting in formation of a friction mark. Further, a difference between $HV_{0.025}$ and $HV_{0.05}$ became less than 30, so that a predetermined carbon concentrated layer is not formed. Therefore, a minute crack is not generated in a titanium sheet surface in a forming process and stresses are concentrated on low-frequency cracks generated as forming progressed, resulting in an inferior formability.

Example 2

Next, there was evaluated an influence to an oxide coating film thickness by a difference in oxidation coating film forming condition in a step of forming an oxidation coating film after an acid pickling treatment. First, a titanium sheet of 4.5 mm in thickness which was fabricated by performing an acid pickling treatment using nitric hydrofluoric acid was subjected to steps b1) to b4) below in sequence, to thereby produce a titanium sheet for test as a sheet of the present invention (sample sheets No. B1 to No. B9).

b1) Step of forming oxide coating film of 20 to 200 nm in thickness after acid pickling treatment In this example, there were performed, in this step, two kinds of oxide coating film forming processings, namely, a heating processing in the atmosphere and an anodic oxidation processing using a phosphoric acid aqueous solution. In the heating processing in the atmosphere, an oxide coating film thickness was adjusted in a temperature range of 350 to 650° C., and in the anodic oxidation, an oxide coating film thickness was adjusted by a voltage range of 20 to 130 V. Note that the oxide coating film thickness was measured by using the same glow discharge optical emission spectrometer (GDS) as above.

b2) Cold-rolling step of performing rolling at reduction ratio of 15% or more per each pass until rolling ratio reaches 70% and thereafter performing rolling until rolling ratio reaches 89% at reduction ratio of 5% or less at least in final pass In this example, the reduction ratio per each pass from the time of the rolling ratio of 70% until the pass previous to the final pass was set to less than 15%.

b3) Cleaning step performed with alkali (in aqueous solution whose major constituent is sodium hydroxide)

b4) Annealing step of holding at temperature of 800° C. for one minute in vacuum atmosphere Comparative sheets below were fabricated in addition to the sample sheets in the present invention.

Comparative sheet IV: titanium sheets for test (sample sheets No. B10 to No. B14) obtained by performing cold-rolling, alkali cleaning and annealing under conditions listed in aforementioned steps b2), b3) and b4) to titanium sheet whose oxide coating film thickness is less than 20 nm or over 200 nm Comparative sheet V: titanium sheets for test (sample sheets No. B15 to No. B17) obtained by performing cold-rolling and alkali cleaning under conditions listed in aforementioned steps b2) and b3) to titanium sheet in which natural oxide coating film was formed without being subjected to step of forming oxide coating film after acid pickling treatment or titanium sheet in which oxide coating film was formed under condition listed in aforementioned step b1), and thereafter performing annealing of holding at temperature of 630° C. for 240 minutes in vacuum In Table 2 shown below, there are listed an annealing step of holding at a temperature of 800° C. for one minute in a vacuum atmosphere as a condition A, and an annealing step of holding at a temperature of 630° C. for 240 minutes in a vacuum atmosphere as a condition B. Crystal grain diameters after the annealing conditions A, B were applied are equal at about 26 μm.

Note that an average crystal grain diameter, a formability, a surface state after a forming test, a surface Vickers hardness and a carbon concentrated layer thickness of each sample sheet were evaluated under the same conditions as above.

TABLE 2

| No. | FORMING CONDITION OF OXIDE COATING FILM: METHOD | FORMING CONDITION OF OXIDE COATING FILM: ATMOSPHERE HEATING: TEMPERATURE (° C.) × TIME (min) ANODIC-OXIDATION: VOLTAGE (V) | OXIDE COATING FILM THICKNESS (nm) | ANNEALING CONDITION*4 | $HV_{0.025}$ | $HV_{0.05}$ | $HV_1$ | DIFFERENCE BETWEEN $HV_{0.025}$ AND $HV_{0.05}$ | CARBON CONCENTRATED LAYER THICKNESS (μm) | BULGING HEIGHT (mm) | PRESENCE/ABSENCE OF MINUTE CRACK*1 | FORMABILITY*2 | REMARKS |
|---|---|---|---|---|---|---|---|---|---|---|---|---|---|
| B1 | ATMOSPHERE HEATING | 350° C. × 15 min | 22 | A | 235 | 202 | 121 | 33 | 7.9 | 20.8 | PRESENT | ○ | SHEET OF PRESENT INVENTION |
| B2 | ATMOSPHERE HEATING | 450° C. × 3 min | 35 | A | 236 | 200 | 122 | 36 | 4.9 | 21.4 | PRESENT | ○ | SHEET OF PRESENT INVENTION |
| B3 | ATMOSPHERE HEATING | 500° C. × 3 min | 50 | A | 236 | 200 | 122 | 36 | 4.8 | 21.5 | PRESENT | ○ | SHEET OF PRESENT INVENTION |
| B4 | ATMOSPHERE HEATING | 600° C. × 3 min | 97 | A | 237 | 202 | 123 | 35 | 4.6 | 21.5 | PRESENT | ○ | SHEET OF PRESENT INVENTION |
| B5 | ATMOSPHERE HEATING | 650° C. × 3 min | 197 | A | 240 | 204 | 123 | 36 | 5.5 | 20.9 | PRESENT | ○ | SHEET OF PRESENT INVENTION |
| B6 | ANODIC OXIDATION | 20 V | 21 | A | 236 | 203 | 121 | 33 | 8.1 | 20.8 | PRESENT | ○ | SHEET OF PRESENT INVENTION |
| B7 | ANODIC OXIDATION | 40 V | 55 | A | 237 | 201 | 122 | 36 | 4.6 | 21.5 | PRESENT | ○ | SHEET OF PRESENT INVENTION |
| B8 | ANODIC OXIDATION | 50 V | 74 | A | 239 | 203 | 122 | 36 | 4.7 | 21.4 | PRESENT | ○ | SHEET OF PRESENT INVENTION |
| B9 | ANODIC OXIDATION | 130 V | 193 | A | 240 | 204 | 123 | 36 | 5.7 | 20.9 | PRESENT | ○ | SHEET OF PRESENT INVENTION |
| B10 | NOT PERFORMED | — | 7**3 | A | 217 | 199 | 125 | 18* | 11.6* | 19.5 | ABSENT* | X | COMPARATIVE SHEET IV |
| B11 | ATMOSPHERE HEATING | 300° C. × 15 min | 14* | A | 214 | 199 | 125 | 15* | 11.4* | 19.6 | ABSENT* | X | COMPARATIVE SHEET IV |
| B12 | ATMOSPHERE HEATING | 750° C. × 3 min | 282* | A | 191* | 176 | 126 | 15* | NO CONCENTRATION* | 19.5 | ABSENT* | X | COMPARATIVE SHEET IV |
| B13 | ANODIC | 10 V | 13* | A | 211 | 198 | 124 | 13* | 11.5* | 19.6 | ABSENT* | X | COMPAR- |

TABLE 2-continued

| No. | FORMING CONDITION OF OXIDE COATING FILM: METHOD | ATMOSPHERE HEATING: TEMPERATURE (° C.) × TIME (min) ANODIC-OXIDATION: VOLTAGE (V) | OXIDE COATING FILM THICK-NESS (nm) | ANNEALING CONDITION*4 | $HV_{0.025}$ | $HV_{0.05}$ | $HV_1$ | DIFFER-ENCE BETWEEN $HV_{0.025}$ AND $HV_{0.05}$ | CARBON CONCENTRATED LAYER THICKNESS (μm) | BULGING HEIGHT (mm) | PRESENCE/ ABSENCE OF MINUTE CRACK*1 | FORM-ABILITY*2 | REMARKS |
|---|---|---|---|---|---|---|---|---|---|---|---|---|---|
| | OXIDATION | | | | | | | | | | | | ATIVE SHEET IV |
| B14 | ANODIC OXIDATION | 170 V | 294* | A | 192* | 175 | 125 | 17* | NO CONCENTRATION* | 19.4 | ABSENT* | X | COMPAR-ATIVE SHEET IV |
| B15 | NOT PERFORMED | — | 7* | B* | 262 | 245 | 128 | 17* | 13.4* | 19.6 | ABSENT* | X | COMPAR-ATIVE SHEET V |
| B16 | ATMOSPHERE HEATING | 500° C. × 3 min | 50 | B* | 210 | 190 | 123 | 20* | 12.0* | 19.9 | ABSENT* | X | COMPAR-ATIVE SHEET V |
| B17 | ANODIC OXIDATION | 40 V | 55 | B* | 205 | 191 | 123 | 14* | 11.8* | 20.0 | ABSENT* | X | COMPAR-ATIVE SHEET V |

*1 Evaluation of "PRESENT" was given to a sample sheet in which cracks of 1 to 9 μm in depth are generated at an average interval of less than 50 μm in a surface after bulging forming.

*2 Regarding a formability, evaluation of ○ was given when a bulging height is 20.5 mm or more and evaluation of X was given when a bulging height is less than 20.5 mm.

*3 A place with "*" means a place out of the range of the present invention.

*4 An annealing step of holding at 800° C. for one minute in a vacuum atmosphere is referred to as "A" and an annealing step of holding at 630° C. for 240 minutes in a vacuum atmosphere is referred to as "B".

Each of the sample sheets No. B1 to No. B9 equivalent to the present invention was cold-rolled in a state where an oxide coating film of 20 to 200 nm in thickness was formed, and a predetermined carbon concentrated layer was formed after annealing. Consequently, in each of the sample sheets, minute cracks were generated in a surface in a forming process to thereby alleviate stress concentration at the time of forming, so that an excellent formability such as a bulging height of 20.5 mm or more was exhibited.

In each of No. B10, B11, B13 being comparative sheets IV, since an oxide coating film before cold-rolling was as thin as less than 20 nm, scuffed rough surfaces scattered in a sample sheet surface after the cold-rolling. Further, a carbon concentrated layer thickness became 10.0 μm or more, so that a difference between $HV_{0.025}$ and $HV_{0.05}$ was as small as less than 30. Therefore, a coarse crack was generated in the surface at the time of forming and stress concentration was no alleviated, leading to an inferior formability. Further, in No. B12, B14 being the comparative sheets IV, since an oxide coating film before cold-rolling was as thick as over 200 nm, a carbon concentrated layer was not formed, thereby making $HV_{0.025}$ be small Therefore, a minute crack was not generated in a surface in a forming process and stresses were concentrated on low-frequency cracks generated as forming proceeded, resulting in an inferior formability.

Regarding each of No. B15 to No. B17 being the comparative sheets V, since a holding time period at the time of annealing was long, a carbon concentrated layer thickness was 10.0 μm or more, so that a difference between $HV_{0.025}$ and $HV_{0.05}$ was as small as less than 30. Therefore, a coarse crack was generated in the surface at the time of forming and stress concentration was not alleviated, leading to an inferior formability.

Example 3

Next, detailed examples regarding an effect of pass schedule of cold-rolling will be described. First, a titanium sheet of 4.5 mm in thickness fabricated by an acid pickling treatment using nitric hydrofluoric acid was subjected to steps c1) to c4) below in sequence, to thereby produce a titanium sheet for test as a sheet of the present invention (sample sheets No. C1 to No. C3, No. C7 to No. C9).

c1) Step of forming oxide coating film of 20 to 200 nm in thickness after acid pickling treatment In this example, there were performed, in this step, two kinds of oxide coating film forming processings, namely, a heating processing in the atmosphere and an anodic oxidation processing using a phosphoric acid aqueous solution. In the heating processing in the atmosphere, an oxide coating film thickness was adjusted in a temperature range of 350 to 650° C., and in anodic oxidation, an oxide coating film thickness was adjusted by a voltage range of 20 to 130 V. Note that the oxide coating film thickness was measured by using the same glow discharge optical emission spectrometer (GDS) as above.

c2) Cold-rolling step of performing rolling based on cold-rolling pass schedule listed in P1 to P3 of Table 3 below c3) Cleaning step performed with alkali (in aqueous solution whose major constituent is sodium hydroxide)

c4) Annealing step of holding at temperature of 800° C. for one minute in vacuum atmosphere Comparative sheets below were fabricated in addition to the sample sheets in the present invention.

Comparative sheet VI: titanium sheets for test (sample sheets No. C4 to No. C6, No. C10 to No. C12) obtained by performing, to titanium sheet in which oxide coating film was formed under condition listed in aforementioned step c1), cold-rolling by cold-rolling pass schedule listed in P4 to P6 of Table 3 below and thereafter performing alkali cleaning and annealing under conditions described in aforementioned steps c3) and c4).

TABLE 3

| | COLD-ROLLING CONDITION | | | | | | | | | | | |
|---|---|---|---|---|---|---|---|---|---|---|---|---|
| | P 1 | | P 2 | | P 3 | | P 4 | | P 5 | | P 6 | |
| NUMBER OF PASSES | REDUCTION RATIO OF EACH PASS | ROLLING RATIO | REDUCTION RATIO OF EACH PASS | ROLLING RATIO | REDUCTION RATIO OF EACH PASS | ROLLING RATIO | REDUCTION RATIO OF EACH PASS | ROLLING RATIO | REDUCTION RATIO OF EACH PASS | ROLLING RATIO | REDUCTION RATIO OF EACH PASS | ROLLING RATIO |
| 1 | 16.7% | 16.7% | 16.7% | 16.7% | 24.4% | 24.4% | 24.4% | 24.4% | 11.1% | 11.1% | 11.1% | 11.1% |
| 2 | 17.1% | 30.9% | 17.1% | 30.9% | 23.5% | 42.2% | 23.5% | 42.2% | 12.5% | 22.2% | 12.5% | 22.2% |
| 3 | 17.0% | 42.7% | 17.0% | 42.7% | 23.1% | 55.6% | 23.1% | 55.6% | 11.4% | 31.1% | 11.4% | 31.1% |
| 4 | 17.1% | 52.4% | 17.1% | 52.4% | 23.0% | 65.8% | 18.5% | 63.8% | 12.9% | 40.0% | 12.9% | 40.0% |
| 5 | 16.8% | 60.4% | 16.8% | 60.4% | 14.3% | 70.7% | 17.2% | 70.0% | 11.1% | 46.7% | 11.1% | 46.7% |
| 6 | 16.9% | 67.1% | 16.9% | 67.1% | 10.6% | 73.8% | 12.6% | 73.8% | 12.5% | 53.3% | 12.5% | 53.3% |
| 7 | 12.2% | 71.1% | 13.5% | 71.6% | 11.0% | 76.7% | 11.0% | 76.7% | 11.9% | 58.9% | 11.9% | 58.9% |
| 8 | 11.5% | 74.4% | 12.5% | 75.1% | 10.5% | 79.1% | 10.5% | 79.1% | 11.4% | 63.6% | 11.4% | 63.6% |
| 9 | 11.3% | 77.3% | 12.5% | 78.2% | 9.6% | 81.1% | 10.6% | 81.3% | 12.2% | 68.0% | 12.2% | 68.0% |
| 10 | 10.8% | 79.8% | 12.2% | 80.9% | 9.4% | 82.9% | 10.7% | 83.3% | 13.2% | 72.2% | 13.2% | 72.2% |
| 11 | 9.9% | 81.8% | 11.6% | 83.1% | 9.1% | 84.4% | 10.7% | 85.1% | 13.6% | 76.0% | 13.6% | 76.0% |
| 12 | 9.8% | 83.6% | 10.5% | 84.9% | 8.6% | 85.8% | 10.4% | 86.7% | 13.9% | 79.3% | 13.9% | 79.3% |
| 13 | 9.5% | 85.1% | 10.3% | 86.4% | 7.8% | 86.9% | 8.3% | 87.8% | 12.9% | 82.0% | 12.9% | 82.0% |
| 14 | 9.0% | 86.4% | 8.2% | 87.6% | 6.8% | 87.8% | 9.1% | 88.9% | 11.1% | 84.0% | 11.1% | 84.0% |
| 15 | 8.2% | 87.6% | 5.4% | 88.2% | 5.5% | 88.4% | — | — | 13.9% | 86.2% | 13.9% | 86.2% |
| 16 | 7.1% | 88.4% | 3.8% | 88.7% | 3.8% | 88.9% | — | — | 9.7% | 87.6% | 9.7% | 87.6% |
| 17 | 3.8% | 88.9% | 2.0% | 88.9% | — | — | — | — | 7.1% | 88.4% | 10.7% | 88.9% |
| 18 | — | — | — | — | — | — | — | — | 3.8% | 88.9% | — | — |
| REMARKS | EXAMPLE OF PRESENT INVENTION | | EXAMPLE OF PRESENT INVENTION | | EXAMPLE OF PRESENT INVENTION | | COMPARATIVE EXAMPLE | | COMPARATIVE EXAMPLE | | COMPARATIVE EXAMPLE | |

Table 4 below lists evaluation results of characteristics of each titanium sheet for test. Note that an average crystal grain diameter, a formability, a surface state after a forming test, a surface Vickers hardness and a carbon concentrated layer thickness of each sample sheet were evaluated under the same conditions as above.

TABLE 4

| | FORMING CONDITION OF OXIDE COATING FILM | | | | | | | |
|---|---|---|---|---|---|---|---|---|
| No. | METHOD | ATMOSPHERE HEATING: TEMPERATURE (° C.) × TIME (min) ANODICOXIDATION: VOLTAGE (V) | OXIDE COATING FILM THICKNESS (nm) | COLD-ROLLING CONDITION*5 | ANNEALING CONDITION*4 | $HV_{0.025}$ | $HV_{0.05}$ | $HV_1$ |
| C1 | ATMOSPHERE HEATING | 500° C. × 3 min | 50 | P1 | A | 236 | 199 | 122 |
| C2 | ATMOSPHERE HEATING | 500° C. × 3 min | 50 | P2 | A | 235 | 200 | 124 |
| C3 | ATMOSPHERE HEATING | 500° C. × 3 min | 50 | P3 | A | 235 | 199 | 122 |
| C4 | ATMOSPHERE HEATING | 500° C. × 3 min | 50 | P4* | A | 206 | 190 | 123 |
| C5 | ATMOSPHERE HEATING | 500° C. × 3 min | 50 | P5* | A | 189* | 170 | 124 |
| C6 | ATMOSPHERE HEATING | 500° C. × 3 min | 50 | P6* | A | 188* | 170 | 124 |
| C7 | ANODIC OXIDATION | 40 V | 55 | P1 | A | 237 | 200 | 122 |
| C8 | ANODIC OXIDATION | 40 V | 55 | P2 | A | 238 | 199 | 123 |
| C9 | ANODIC OXIDATION | 40 V | 55 | P3 | A | 236 | 198 | 123 |
| C10 | ANODIC OXIDATION | 40 V | 55 | P4* | A | 205 | 189 | 124 |
| C11 | ANODIC OXIDATION | 40 V | 55 | P5* | A | 190* | 169 | 124 |
| C12 | ANODIC OXIDATION | 40 V | 55 | P6* | A | 191* | 172 | 123 |

| No. | DIFFERENCE BETWEEN $HV_{0.025}$ AND $HV_{0.05}$ | CARBON CONCENTRATED LAYER THICKNESS (μm) | BULGING HEIGHT (mm) | PRESENCE/ ABSENCE OF MINUTE CRACK*1 | FORMABILITY*2 | REMARKS |
|---|---|---|---|---|---|---|
| C1 | 37 | 4.9 | 21.6 | PRESENT | ○ | SHEET OF PRESENT INVENTION |
| C2 | 35 | 4.8 | 21.6 | PRESENT | ○ | SHEET OF PRESENT INVENTION |
| C3 | 36 | 4.8 | 21.5 | PRESENT | ○ | SHEET OF PRESENT INVENTION |
| C4 | 16* | NO CONCENTRATION* | 19.9 | ABSENT* | X | COMPARATIVE SHEET VI |
| C5 | 19* | NO CONCENTRATION* | 19.8 | ABSENT* | X | COMPARATIVE SHEET VI |
| C6 | 18* | NO CONCENTRATION* | 19.9 | ABSENT* | X | COMPARATIVE SHEET VI |
| C7 | 37 | 4.7 | 21.5 | PRESENT | ○ | SHEET OF PRESENT INVENTION |
| C8 | 39 | 4.6 | 21.4 | PRESENT | ○ | SHEET OF PRESENT INVENTION |
| C9 | 38 | 4.7 | 21.6 | PRESENT | ○ | SHEET OF PRESENT INVENTION |

TABLE 4-continued

| | | | | | | |
|---|---|---|---|---|---|---|
| C10 | 16* | NO CONCENTRATION* | 19.9 | ABSENT* | X | COMPARATIVE SHEET VI |
| C11 | 21* | NO CONCENTRATION* | 19.8 | ABSENT* | X | COMPARATIVE SHEET VI |
| C12 | 19* | NO CONCENTRATION* | 19.7 | ABSENT* | X | COMPARATIVE SHEET VI |

*[1]Evaluation of "PRESENT" was given to a sample sheet in which cracks of 1 to 9 μm in depth are generated at an average interval of less than 50 μm in a surface after bulging forming.
*[2]Regarding a formability, evaluation of ○ was given when a bulging height is 20.5 mm or more and evaluation of X was given when a bulging height is less than 20.5 mm.
*[3]A place with "*" means a place out of the range of the present invention.
*[4]An annealing step of holding at 800° C. for one minute in a vacuum atmosphere is referred to as "A".
*[5]A symbol of a cold-rolling condition (pass schedule) in Table 3 is listed.

In each of the sample sheets No. C1 to No. C3, No. C7 to No. C9 equivalent to the present invention, a reduction ratio per each pass until reaching a rolling ratio of 70% was 15% or more, and in the rolling thereafter, at least in a final pass, cold-rolling was performed at a reduction ratio of 5% or less. Consequently, in each of the sample sheets, minute cracks were generated in a surface in a forming process to thereby alleviate stress concentration at the time of forming, so that an excellent formability such as a bulging height of 20.5 mm or more was exhibited.

Regarding each of No. C4 to No. C6, No. C10 to No. C12 being the comparative sheets VI, cold rolling was performed under a condition not satisfying at least either one of the cold-rolling conditions according to the present invention, namely, "reduction ratio per each pass until reaching a rolling ratio of 70% is 15% or more and a reduction ratio in subsequent rolling, at least in the final pass, is 5% or less". Consequently, a carbon concentrated layer was not formed and a minute crack was not generated in the surface in the forming process, so that stresses were concentrated on low-frequency cracks generated as forming progressed, resulting in an inferior formability.

INDUSTRIAL APPLICABILITY

According to the present invention, by forming a thin and hard layer uniformly in a surface, numerous minute cracks can be generated in the surface in a forming process, to thereby alleviate stress concentration at the time of forming, so that a titanium sheet exhibiting an excellent formability can be provided. This titanium sheet, since being excellent in formability, is particularly useful as a material for a heat exchanger in a chemical plant, an electric power plant and a food manufacturing plant, for example.

The invention claimed is:

1. A titanium sheet, wherein, when a carbon concentration of a base material is $C_b$ (mass %) and a carbon concentration at a depth d μm from a surface is $C_d$ (mass %), the depth d (carbon concentrated layer thickness) satisfying $C_d/C_b>1.5$ is 3.0 μm or more and less than 10.0 μm, wherein a Vickers hardness $HV_{0.025}$ at a load of 0.245 N in the surface is 200 or more, a Vickers hardness $HV_{0.05}$ at a load of 0.49 N in the surface is lower than $HV_{0.025}$, and a difference between $HV_{0.025}$ and $HV_{0.05}$ is 30 or more, wherein a Vickers hardness $HV_1$ at a load of 9.8 N in the surface is 150 or less, and wherein an average interval between cracks generated in the surface when a strain of 25% is given in a rolling direction in a bulging forming process is less than 50 μm and a depth thereof is 1 μm or more and less than 10 μm.

2. A method for manufacturing the titanium sheet according to claim 1, the manufacturing method comprising:

after performing hot-rolling and descaling, forming an oxide coating film of 20 to 200 nm in thickness in a titanium sheet;

performing cold-rolling to the titanium sheet by using mineral oil as lubricant oil at a reduction ratio of 15% or more per each pass until a rolling ratio of 70% is reached; thereafter, performing cold-rolling at a reduction ratio of 5% or less at least in a final pass; and performing annealing to the cold-rolled titanium sheet by holding in a temperature range of 750 to 810° C. for 0.5 to 5 minutes in a vacuum or Ar gas atmosphere.

* * * * *